US011912948B1

(12) United States Patent
Mathur

(10) Patent No.: US 11,912,948 B1
(45) Date of Patent: Feb. 27, 2024

(54) LOW VOLATILITY SMALL ENGINE FUEL COMPOSITION

(71) Applicant: Monument Chemical Houston, LLC, Houston, TX (US)

(72) Inventor: Indresh Mathur, Sugar Land, TX (US)

(73) Assignee: Monument Chemical Houston, LLC, Houston, TX (US)

( * ) Notice: Subject to any disclaimer, the term of this patent is extended or adjusted under 35 U.S.C. 154(b) by 0 days.

(21) Appl. No.: 18/129,561

(22) Filed: Mar. 31, 2023

(51) Int. Cl.
*C10L 1/08* (2006.01)

(52) U.S. Cl.
CPC ..... *C10L 1/08* (2013.01); *C10L 2200/0461* (2013.01); *C10L 2270/023* (2013.01)

(58) Field of Classification Search
CPC ..... C10L 1/08; C10L 2200/0461; C10L 2270/023
USPC ..... 585/14
See application file for complete search history.

(56) References Cited

U.S. PATENT DOCUMENTS

2020/0040275 A1* 2/2020 D'Acosta ..... C10L 1/023
2021/0040407 A1* 2/2021 Dauphin ..... C10L 10/10

* cited by examiner

*Primary Examiner* — Prem C Singh
*Assistant Examiner* — Francis C Campanell
(74) *Attorney, Agent, or Firm* — Gunther J. Evanina; Butzel Long

(57) ABSTRACT

A small engine fuel composition suitable for use in a four-stroke engine, or capable of being blended with a lubricant for use in a two-stroke engine, includes 40% to 50% by volume isooctane, 15% to 25% alkylate feedstock by volume, 5% to 15% by volume of one or more aromatic compounds having from 7 to 8 carbon atoms, 10% to 20% by volume of a first refinery blendstock having a minimum of 98.0 volume percent aromatic compounds and having a flashpoint temperature of about 100 degrees Fahrenheit (known as "Aromatic 100'), and 5% to 15% by volume of a second refinery blendstock having a minimum of 98.0 volume percent aromatic compounds and having a flashpoint temperature of about 150 degrees Fahrenheit (known as "Aromatic 150").

25 Claims, No Drawings

LOW VOLATILITY SMALL ENGINE FUEL COMPOSITION

FIELD OF THE DISCLOSURE

This disclosure pertains to fuels and specifically to fuels for use in two-cycle and four-cycle small engines.

BACKGROUND OF THE DISCLOSURE

Small engine fuels are commonly formulated to maintain long term stability. Unlike vehicle engines used in cars, trucks, buses and the like, two-cycle and four-cycle small engines often are used on an occasional basis with fuel subjected to longer storage times. This can cause certain fuel components to agglomerate or polymerize. Also, due to the typically longer periods of time in which small engine fuels are stored, there is a greater possibility of oxidation and moisture absorption, especially for fuels containing ethanol, which can lead to poor combustion, engine damage, carburetor fouling, and higher emissions of odorous gases and smoke that are potentially harmful to the equipment, operator and environment.

Efforts to improve fuel stability have generally involved reducing or eliminating undesirable components present in ordinary gasoline, such as unsaturated components (e.g., olefins), oxygenates (e.g., methanol), and aromatic compounds, and adding fuel stabilizers, which typically comprise a proprietary blend of antioxidants, metal deactivators, peroxide neutralizers and dispersants.

A problem with these conventional storage-stable small engine fuels is that they tend to be more volatile than ordinary gasoline, due at least in part to the substantial reduction or elimination of aromatic compounds. This higher volatility can cause fuel pressurization in closed containers during summer months, and/or in warmer climates, which upon opening of the fuel container, can result in the formation of combustible vapor/air mixtures that could explosively ignite and cause significant harm to people and property in the immediate vicinity.

Additionally, conventional storage-stable small engine fuels are engineered compositions made from highly refined ingredients, which generally exclude the use of lower cost petroleum feedstocks. Compositions utilizing stabilizers can employ lower cost ingredients, but this savings is significantly offset by the added cost of the stabilizer.

SUMMARY OF THE DISCLOSURE

The storage-stable small engine fuels of this disclosure are formulated with aromatic and alkylate blendstocks, and can be formulated without a stabilizer, to provide a lower cost product adapted for long term storage.

Disclosed is a small engine fuel composition suitable for use in a four-stroke engine, or capable of being blended with a lubricant for use in a two-stroke engine, which includes 40% to 50% by volume isooctane, 15% to 25% alkylate feedstock by volume, 5% to 15% by volume of one or more aromatic compounds having from 7 to 8 carbon atoms, 10% to 20% by volume of a first refinery blendstock having a minimum of 98.0 volume percent aromatic compounds and having a flashpoint temperature of about 100 degrees Fahrenheit (known as "Aromatic 100'), and 5% to 15% by volume of a second refinery blendstock having a minimum of 98.0 volume percent aromatic compounds and having a flashpoint temperature of about 150 degrees Fahrenheit (known as "Aromatic 150").

In certain aspects of this disclosure, the total amount of branched alkanes can be from 60% to 70% by volume of the small engine composition and the total amount of aromatic compounds can be from 30% to 40% by volume. The composition can have an initial boiling temperature equal to or greater than 70° C. or 80° C., a final boiling temperature of 200° C. to 215° C., or 205° C. to 210° C., a motor octane number (MON) greater than 94 or greater than 92, a research octane number (RON) of about 104 (e.g., 100 to 110), a dry vapor pressure equivalent (DVPE) of about 12.9 k/Pa (1.87 psi) or from about 12.5 to 13.5 k/Pa, and a density of about 0.77 kg/m$^3$ at 15° C. (e.g., 0.75 to 0.79 or 0.76 to 0.78 kg/m$^3$). The composition of this disclosure can have an oxygenates content that is less than 0.1% by weight.

DETAILED DESCRIPTION

The disclosed small engine fuel compositions provide a favorable combination of storage stability, lower cost, lower volatility, and improved safety.

The compositions for four-stroke engines contain isooctane (2,2,4-trimethylpentane) in an amount from 40% to 50% by volume, 42% to 48% by volume, or from 44% to 46% by volume. The compositions also contain from 15% to 25% by volume of an alkylate blendstock, 5% to 15% by volume of one or more aromatic compounds comprising 7 to 8 carbon atoms, 10% to 20% by volume of an aromatic blendstock having an aromatic content of at least 98.0% by volume and a flashpoint temperature of about 100 degrees Fahrenheit (e.g., 95° F. to 105° F.), and from 5% to 15% by weight of an aromatic blendstock having an aromatic content of at least 98.0% by volume and a flashpoint temperature of about 150 degrees Fahrenheit (e.g., 145° F. to 155° F.).

The alkylate blendstock can be, and preferably is, a product of a petroleum refinery alkylation unit that converts light olefins (e.g., butylene) into a high-quality gasoline blendstock. Alkylate blendstocks are characterized by low (less than 1 ppm) or no sulfur content, very low or no aromatic content (less than 1% by volume), and high octane number (e.g., a MON from about 88 to about 94), and a Reid Vapor Pressure of from about 2.6 to 4.0 psi (ASTM D6370-20, Jun. 26, 2020). Alkylate blendstocks typically comprise at least 98% or at least 99% by volume of saturated hydrocarbons (alkanes), and less than 2%, or less than 1% aromatic and olefinic compounds. Refinery alkylates typically comprise greater than 65%, or greater than 70% by volume of branched alkanes having 8 carbon atoms, namely 2,2,4-trimethylpentane, 2,3,3-trimethylpentane, 2,3,4-trimethylpentane, 2,4-dimethylhexane, with the trimethylpentanes typically consisting over 60% by volume of the alkylate blendstock.

The aromatic blendstock having a flashpoint temperature of about 100 degrees Fahrenheit is commonly known in the petroleum industry as Aromatic 100. Aromatic 100 is produced from petroleum-based raw materials and has an aromatic content of at least 98% by volume or at least 99% by volume and is comprised primarily (i.e., greater than 50% by volume) of di-alkylbenzenes and tri-alkylbenzenes (i.e., aromatic compounds having 9 or 10 carbon atoms. Aromatic 100 typically has a specific gravity (at 60° F.) of about 0.87 (as determined in accordance with ASTM D4052-22, May 18, 2022), an API gravity (at 60° F.) of about 29.9 (as determined in accordance with ASTM D287-22 (Feb. 1, 2023)), a flashpoint of about 128° F. (as determined in accordance with ASTM D93-20, Aug. 7, 2020), an initial boiling point of about 322° F. (as determined in accordance with ASTM D86-20b, Oct. 8, 2020), a final boiling point of about 357° F. (ASTM D86-20b), a Kauri-Butanol value greater than 90.0 (as determined in accordance with ASTM D1133-13, Aug. 10, 2021), a sulfur content less than 1.0 ppm (as determined in accordance with ASTM D3120-08, Jun. 25, 2019), a total aromatics content greater than 98% or greater than 99% (as determined in accordance with ASTM D1319-20a, Sep. 14, 2020), and a color of +30 Saybolt (as determined in accordance with ASTM D156-15, Dec. 27, 2016).

The aromatic blendstock having a flashpoint temperature of about 150 degrees Fahrenheit is commonly known in the petroleum industry as Aromatic 150. Aromatic 150 is produced from petroleum-based raw materials and has an aromatic content of at least 98% by volume, or at least 99% by volume, and is comprised primarily (i.e., greater than 50% by volume) of aromatic compounds having from 9 to 11 carbon atoms. Aromatic 150 typically has a specific gravity (at 60° F.) of about 0.87, an API gravity (at 60° F.) of about 30.4, a flashpoint of about 144° F. an initial boiling point of about 346° F., a final boiling point of about 379° F., a Kauri-Butanol value of about 88, a sulfur content of about 0.5 ppm, a total aromatics content greater than 98% or greater than 99%, and a color of +30 Saybolt (all values determined using the same test standards as previously recited for Aromatic 100).

The amount of isooctane (neat) can be varied within the broader range (of 40% to 50% by volume), and is preferably 43% to 47%, such as from 44% to 46%. The amount of alkylate blendstock can be varied within the broader range (of 15% to 25% by volume), and is preferably 17% to 23%, such as from 18% to 22%, or about 20%). Artificially blended or simulated alkylate blendstocks can be substituted (e.g., obtained by mixing branched alkanes, primarily consisting of isooctanes). However, such simulated alkylate blendstocks would be more costly.

The amount of Aromatic 100 can be varied within the broader range (of 10% to 20% by volume), and is preferably 12% to 18%, 14% to 16%, or about 15%. A simulated Aromatic 100 may be substituted for the refinery blendstock, such as by mixing aromatic compounds having 9 and 10 carbon atoms. However, this would be more costly.

The amount of Aromatic 150 can be varied within the broader range (of 5% to 15% by volume), and is preferably 7% to 13%, or 9% to 11%, or about 10%. A simulated Aromatic 150 can be substituted for the refinery blendstock, such as by mixing aromatic compounds having from 9 to 11 carbon atoms. However, this would be more costly.

The aromatic compound having from 7 to 8 carbon atoms, or mixture of aromatic compounds having from 7 to 8 carbon atoms can be selected from toluene, the xylenes, and ethylbenzene. The aromatics having 7 to 8 carbon atoms is preferably toluene or a composition comprising primarily of toluene (e.g., more than 50% toluene) with only small or negligible amounts of other low molecular weight (C8) aromatic compounds. The amount of C7 to C8 aromatic compounds can be varied within the broader range (of from 5% to 15% by volume), and is preferably 7% to 13%, 9% to 11%, or about 10%.

Upon mixing or blending the required isooctane, (C7 to C8 aromatics), the alkylate blendstock, the Aromatic 100 blendstock, and the Aromatic 150 blendstock, the resulting fuel can have a total olefins, cycloalkanes, isobutane and isopentane content that is less than 2% by volume or less than 1% by volume. The resulting fuel can have a total amount of branched alkanes from 50% to 70% by volume, and a total amount of aromatic compounds from 30% to 40% by volume. The resulting fuel can have an initial boiling point temperature greater than 70° C. or greater than 80° C. (as determined in accordance with ASTM D86-20b), a total oxygenates content (compounds having an oxygen atom, such as alcohols and ethers) less than 0.1% by volume (as determined in accordance with ASTM D5599-22, Apr. 6, 2022), a Research Octane Number (RON) of about 104 (as determined in accordance with ASTM D2699-21, Oct. 21, 2022), such as a RON of from 100 to 110 or from about 101 to about 104, Motor Octane Number (MON) of about 94, such as a MON of from 90 to 100 or from about 91 to about 94 (as determined in accordance with ASTM D2700-22a, Jan. 13, 2023), a final boiling point temperature of from 200° C. to 215° C., such as from 205° C. to 210° C. (as determined in accordance with ASTM D86-20b), a dry vapor pressure equivalent (DVPE) of about 12.9 kPa (1.87 psi), such as 12.5 to 13.3 kPa, as determined in accordance with ASTM D5191-22, and a density of about 0.77 kg/m$^3$ at 15° C. (as determined in accordance with ASTM D4052-22, May 18, 2022), such as 0.76 kg/m$^3$ to 0.78 kg/m$^3$.

Table 1 list the distillation profile and other properties of the resulting fuel (labeled Fuel C) as compared with commercially available storage-stable small engine fuels (labeled Fuel A, Fuel B).

TABLE 1

| Property | Test Standard** | Units | Fuel A | Fuel B | Fuel C |
|---|---|---|---|---|---|
| Distillation - IBP | ASTM D86 | ° C. | 32.1 | 32.4 | 77 |
| 5% | | ° C. | 48.7 | 50.1 | 99 |
| 10% | | ° C. | 55.5 | 60.2 | 103 |
| 20% | | ° C. | 66.3 | 75.6 | 107 |
| 30% | | ° C. | 81.5 | 88.8 | 110 |
| 40% | | ° C. | 96.2 | 97.7 | 113 |
| 50% | | ° C. | 102.6 | 102.7 | 118 |
| 60% | | ° C. | 106.1 | 105.5 | 126 |
| 70% | | ° C. | 110.3 | 108.1 | 146 |
| 80% | | ° C. | 116.6 | 111.9 | 170 |
| 90% | | ° C. | 155.5 | 121.4 | 179 |
| Distillation - EP | | ° C. | 193.5 | 191.4 | 208 |
| Recovery | | ml | 98.1 | 97.1 | 98.2 |
| Residue | | ml | 0.8 | 1.1 | 1.0 |
| Loss | | ml | 1.1 | 1.8 | 0.7 |
| % evaporated @ 70 C. | | vol % | 22.7 | 17 | 0.0 |
| % evaporated @ 100 C. | | vol % | 44.3 | 44.3 | 6.5 |
| % evaporated @ 180 C. | | vol % | 96.8 | 97 | 90.5 |
| Gravity | ASTM D4052 | °API | 73.7 | 72 | 51.3 |
| Density @ 15 C. | ASTM D4052 | g/cm$^3$ | 0.6888 | 0.6949 | 0.7689 |
| DVPE, RVP | ASTM D5191 | k/Pa | 58.5 | 61.6 | 12.89 |
| Oxygenates | ASTM D5599 | wt % | <0.01 | <0.01 | <0.1 |
| Sulfur | ASTM D5453 | wt % | 0.0002 | 0.0007 | 3 |
| Total aromatics | ASTM D5769 | vol % | <0.1 | 0.1 | 35.5 |
| Total olefins | ISO22854 | vo1 % | 0.15 | 0.3 | 1.4 |
| Benzene | ISO22854 | vol % | <0.01 | <0.01 | 0.03 |
| C4 hydrocarbon | ISO22854 | wt % | 2.09 | 3.96 | 0.26 |
| Total cycloalkanes | ASTM D5134 | vol % | <0.01 | 0.02 | <0.01 |
| n-hexane | ASTM D5134 | vol % | <0.01 | <0.01 | <0.01 |

TABLE 1-continued

| Property | Test Standard** | Units | Fuel A | Fuel B | Fuel C |
|---|---|---|---|---|---|
| 1,3 butadiene | ASTM D6729 | wt % | <0.01 | <0.01 | <0.01 |
| Motor Octane Number | ASTM D2700 | | 93 | 91.6 | 93.8 |
| Research Octane Number | ASTM D2699 | | | 94.2 | 104 |
| Octane (AKI) | | | | | |

**All test standards refer to the most recent revision at the time of filing this application.

The resulting fuel can be more safely used in hot climates and environments (e.g., by forest firefighters) as compared with conventional storage stable small engine fuels, and produced at a lower cost than currently marketed storage stable fuels, while exhibiting comparable storage stability. This fuel optimally eliminates the need for stabilizing additives that are commonly employed in commercially available stable-storage small engine fuels, whereby a cleaner burning product that emits less odorous gases and smoke is provided. The resulting fuel (Fuel C) is extremely clean, substantially free of carcinogenic compounds, such as benzene, substantially odor free, produces cleaner exhaust fumes during combustion, is substantially free of olefins whereby carburetor life is increased and gaskets/o-rings are less prone to softening. The resulting fuel also has a very low sulfur content, and comprises very low amounts of hydrocarbons having fewer than 6 carbon atoms (e.g., less than 1% or less than 2% by volume of butanes and pentanes), resulting in a low vapor pressure that mitigates fuel container pressurization. The fuel is expected to have a storage stability of at least 5 years in closed containers, during which no significant polymerization or agglomeration occurs, and no significant amount of oxidation or acidification occurs.

The fuel described above can be used as a base fuel that is blended with a lubricant (motor oil) to provide a fuel for use in a two-cycle engine. The base fuel generally comprises about 95% to 98% by volume of the two-stroke engine fuel, with the balance of about 1.7% to about 5% by volume being lubricant. Typical base fuel to lubricant ratios are 32:1, 40:1 and 50:1.

In accordance with certain embodiments, fuels having characteristics and advantages of the previously described fuels can be achieved by substituting a branched alkane having 12 carbon atoms for a portion of the aromatic blendstocks (Aromatic 100 and Aromatic 150). These compositions are substantially equivalent functionally, but can be slightly more expensive to produce because they comprise smaller amounts of lower cost refinery blendstocks, but are expected to have improved stability. Such compositions include isooctane in an amount from 40% to 50% by volume, 42% to 48% by volume, or from 44% to 46% by volume. The compositions also contain from 15% to 25% by volume of an alkylate blendstock, 5% to 15% by volume of one or more aromatic compounds comprising 7 to 8 carbon atoms, 0% to 20% by volume of an aromatic blendstock having an aromatic content of at least 98.0% by volume and a flashpoint temperature of about 100 degrees Fahrenheit (e.g., 95° F. to 105° F.), and from 0% to 15% by weight of an aromatic blendstock having an aromatic content of at least 98.0% by volume and a flashpoint temperature of about 150 degrees Fahrenheit (e.g., 145° F. to 155° F.), a C12 branched alkyl in an amount of from 0% to 15% by volume, wherein the total amount of the first refinery blendstock, the second refinery blendstock, and C12 branched alkane is from 20% to 30% by volume of the composition. The C12 branched alkane is preferably a compound having a boiling point of from about 160° C. to 180° C., with particularly suitable C12 branched alkanes selected from triisobutylene, isododecane, or a combination of triisobutylene and isododecane.

The described embodiments are not limiting. Various modifications are considered within the purview and scope of the appended claims.

What is claimed is:

1. A fuel composition comprising:

isooctane in an amount of from 40% to 50% by volume of the composition;

an alkylate blendstock in an amount of from 15% to 25% by volume of the composition;

an aromatic compound or a mixture of aromatic compounds having 7 and/or 8 carbon atoms, the aromatic compound or compounds having 7 and/or 8 carbon atoms being from 5% to 15% of the composition by volume;

a first refinery blendstock having a minimum of 98.0 volume percent aromatic compounds and having a flashpoint temperature of about 100 degrees Fahrenheit, the first refinery blendstock being from 10% to 20% by volume of the composition; and a second refinery blendstock having a minimum of 98.0 volume percent aromatic compounds and having a flashpoint temperature of about 150 degrees Fahrenheit, the second refinery blendstock being from 5% to 15% by volume of the composition.

2. The composition of claim 1, wherein the total amount of olefins, cycloalkanes, isobutane and isopentane is less than 2% by volume.

3. The composition of claim 1, wherein the total amount of branched alkanes is from 50% to 70% by volume, and the total amount of aromatic compounds is from 30% to 40% by volume.

4. The composition of claim 1 having an initial boiling temperature that is equal to or greater than 70° C.

5. The composition of claim 1 having an initial boiling temperature that is equal to or greater than 80° C.

6. The composition of claim 1, wherein oxygenates are present in the composition in an amount of less than 0.1% by volume.

7. The composition of claim 1 having a Research Octane Number of about 101 to about 104, as determined using the procedures of ASTM D2699-21, (Oct. 21, 2022); and a Motor Octane Number of about 91 to about 94, as determined using the procedures of ASTM D2700-22a.

8. The composition of claim 1 having a final boiling temperature of from 200° C. to 215° C., as determined using ASTM D86-20b.

9. The composition of claim 1 having a final boiling temperature of from 205° C. to 210° C., as determined using ASTM D86-20b.

10. The composition of claim 1 having a dry vapor pressure equivalent (DVPE) of about 12.9 kPa (1.87 psi), as determined using ASTM D5191-22.

11. The composition of claim 1 having a density of about 0.77 kg/m$^3$ at 15° C., as determined using ASTM D4052-22.

12. A fuel composition for a two-stroke engine, comprising:

a blend of a base fuel and a lubricant;

wherein the blend comprises about 1.7% to about 5% by volume of the lubricant and from about 95% to about 98% by volume of the base fuel; and wherein the base fuel is a mixture of isooctane in an amount of from 40% to 50% by volume; alkylate blendstock in an amount of from 15% to 25% by volume; an aromatic compound or a mixture of aromatic compounds having 7 and/or 8 carbon atoms, the aromatic compound or compounds 7 and/or 8 carbon atoms being from 5% to 15% by volume; a first refinery blendstock having a minimum of 98.0 volume percent aromatic compounds and having a flashpoint temperature of about 100 degrees Fahrenheit, the first refinery blendstock being from 10% to 20% by volume; and a second refinery blendstock having a minimum of 98.0 volume percent aromatic compounds and having a flashpoint temperature of about 150 degrees Fahrenheit, the second refinery blendstock being from 5% to 15% by volume.

13. The composition of claim 12, wherein the total amount olefins, cycloalkanes, isobutane and isopentane is less than 2% by volume.

14. The composition of claim 12, wherein the total amount of branched alkanes is from 50% to 70% by volume, and the total amount of aromatic compounds is from 30% to 40% by volume.

15. The composition of claim 12 having an initial boiling temperature that is equal to or greater than 70° C.

16. The composition of claim 12 having an initial boiling temperature that is equal to or greater than 80° C.

17. The composition of claim 12, wherein oxygenates are present in the composition in an amount of less than 0.1% by volume.

18. The composition of claim 12 having a Research Octane Number of about 101 to about 104, as determined using the procedures of ASTM D2699-21; and a Motor Octane Number of about 91 to about 94, as determined using the procedures of ASTM D2700-22a.

19. The composition of claim 12 having a final boiling temperature of from 200° C. to 215° C., as determined using ASTM D86-20b.

20. The composition of claim 12 having a final boiling temperature of from 205° C. to 210° C., as determined using ASTM D86-20b.

21. The composition of claim 12 having a dry vapor pressure equivalent (DVPE) of about 12.9 kPa (1.87 psi), as determined using ASTM D5191-22.

22. The composition of claim 12 having a density of about 0.77 kg/m$^3$ at 15° C., as determined using ASTM D4052-22.

23. A fuel composition comprising:

isooctane in an amount of from 40% to 50% by volume of the composition;

an alkylate blendstock in an amount of from 15% to 25% by volume of the composition;

an aromatic compound or a mixture of aromatic compounds having 7 and/or 8 carbon atoms, the aromatic compound or compounds having 7 and/or 8 carbon atoms being from 5% to 15% of the composition by volume;

a first refinery blendstock having a minimum of 98.0 volume percent aromatic compounds and having a flashpoint temperature of about 100 degrees Fahrenheit, the first refinery blendstock being from 0% to 20% by volume of the composition;

a second refinery blendstock having a minimum of 98.0 volume percent aromatic compounds and having a flashpoint temperature of about 150 degrees Fahrenheit, the second refinery blendstock being from 0% to 15% by volume of the composition;

triisobutylene, isododecane or a combination of triisobutylene and isododecane, in an amount of from 0% to 15% by volume of the composition;

wherein the total amount of the first refinery blendstock, the second refinery blendstock, triisobutylene and isododecane is from 20% to 30% by volume of the composition.

24. The composition of claim 23, wherein the total amount of olefins, cycloalkanes, isobutane and isopentane is less than 2% by volume; the composition has an initial boiling temperature that is equal to or greater than 70° C., an initial boiling temperature that is equal to or greater than 80° C.; wherein oxygenates are present in the composition in an amount of less than 0.1% by volume, wherein the composition has a Research Octane Number of about 101 to about 104, as determined using the procedures of ASTM D2699-21; and a Motor Octane Number of about 91 to about 94, as determined using the procedures of ASTM D2700-22a; wherein the composition has a final boiling temperature of from 200° C. to 215° C., as determined using ASTM D86-20b; a dry vapor pressure equivalent (DVPE) of about 12.9 kPa (1.87 psi), as determined using ASTM D5191-22, and a density of about 0.77 kg/m$^3$ at 15° C., as determined using ASTM D4052-22.

25. A fuel composition for a two-stroke engine, comprising:

a blend of a base fuel and a lubricant;

wherein the blend comprises about 1.7% to about 5% by volume of the lubricant and from about 95% to about 98% by volume of the base fuel; and wherein the base fuel is a mixture of isooctane in an amount of from 40% to 50% by volume of the composition; an alkylate blendstock in an amount of from 15% to 25% by volume of the composition; an aromatic compound or a mixture of aromatic compounds having from 7 and/or 8 carbon atoms, the aromatic compound or compounds having from 7 and/or 8 carbon atoms being from 5% to 15% of the composition by volume; a first refinery blendstock having a minimum of 98.0 volume percent aromatic compounds and having a flashpoint temperature of about 100 degrees Fahrenheit, the first refinery blendstock being from 0% to 20% by volume of the composition; a second refinery blendstock having a minimum of 98.0 volume percent aromatic compounds and having a flashpoint temperature of about 150 degrees Fahrenheit, the second refinery blendstock being from 0% to 15% by volume of the composition; triisobutylene, isododecane or a combination of triisobutylene and isododecane being from 0% to 15% by volume of the composition; wherein the total amount of the first refinery blendstock, the second refinery blendstock, triisobutylene and isododecane is from 20% to 30% by volume of the composition.

* * * * *